United States Patent [19]

Yamaguchi et al.

[11] 4,312,522

[45] Jan. 26, 1982

[54] HEAT SENSITIVE RECORDING SHEET

[75] Inventors: Akihiro Yamaguchi, Kamakura; Keizaburo Yamaguchi, Kawasaki; Hisamichi Murakami, Yokohama, all of Japan

[73] Assignee: Mitsui Toatsu Chemicals, Inc., Tokyo, Japan

[21] Appl. No.: 177,999

[22] Filed: Aug. 14, 1980

[30] Foreign Application Priority Data

Oct. 24, 1979 [JP] Japan ..... 54/107084

[51] Int. Cl.[3] ..... B41M 5/18; B41M 5/22

[52] U.S. Cl. ..... 282/27.5; 427/150; 427/151; 427/152; 428/411; 428/488; 428/537; 428/913; 428/914; 430/348

[58] Field of Search ..... 282/27.5; 427/150, 151, 427/152; 428/307, 537, 913, 914, 411, 488; 430/348, 945

[56] References Cited

U.S. PATENT DOCUMENTS 3,244,550 4/1966 Farnham et al. ..... 282/27.5

3,843,383 10/1974 Ishige et al. ..... 282/27.5

3,937,864 2/1976 Kohmura et al. ..... 428/488

*Primary Examiner*—Bruce H. Hess

*Attorney, Agent, or Firm*—Fisher, Christen & Sabol

[57] ABSTRACT

This invention discloses a heat sensitive recording sheet which contains, as a developer, at least one of the compounds represented by the general formula

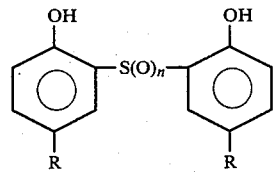

where R represents hydrogen, an alkyl radical of from 1 to 12 carbon atoms, a cycloalkyl radical of from 3 to 10 carbon atoms, an aralkyl radical of from 7 to 10 carbon atoms, and a phenyl radical, and may be identical to or different from each other, n is zero, or an integer of 1 or 2.

The heat sensitive recording sheet of this invention has a sharper rise in developed color density and is advantageous for its handling and storage as well as gives a developed color image having an excellent fastness to light and water resistance in addition to very little decrease in density of the developed color image with time.

7 Claims, No Drawings

HEAT SENSITIVE RECORDING SHEET

FIELD OF THE INVENTION

This invention relates to a heat sensitive recording sheet which is characterized in that the heat sensitive recording sheet contains, as a developer, at least one of the compounds represented by the general formula (I)

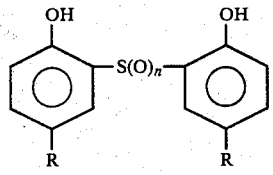

(I)

where R represents hydrogen, an alkyl radical of from 1 to 12 carbon atoms, a cycloalkyl radical of from 3 to 10 carbon atoms, an aralkyl radical of from 7 to 10 carbon atoms, and a phenyl radical, and may be identical to or different from each other, n is zero, or an integer of 1 or 2.

BACKGROUND OF THE INVENTION

A so-called dye color development type heat sensitive recording sheet is well-known in the art, according to which a coupler consisting of electron donative, color assuming com of a solid acid selected from clays such as activated clay, phenol compounds, aromatic carboxylic acids, aromatic polyvalent metal salts, and the like, are brought into contact with each other by heating to obtain a developed color image by the application of the color reaction therebetween.

Generally, the heat sensitive recording sheet is required as conditions for performance thereof, which the sheet should possess, to be colorless or light colored itself, to have a fast developed color image as well as an excellent performance for color development immediately after the preparation of the sheet or after long-term storage of the sheet without the lowering thereof, to be sufficiently stable to light or moisture and further, to be prepared economically. The developer for heat sensitive recording, which has already been proposed and sheets coated with the developer have both merits and demerits from the standpoint of performance and these sheets have such drawbacks that color develops prior to heating on reproduction to produce blushing because two reactants are brought into contact with each other to be coated on a substrate, that they have poor storage stability of a developed image such as light resistance and water resistance and that color does not develop instantly on heating, which demands further an improved heat sensitive recording sheet. Particularly in recent years, an appearance of a novel developer, which has excellent rise in the instantly developed color density on heating and has gradational characteristics for use in a high-speed printer with a short heating pulse length, has been highly demanded.

SUMMARY OF THE INVENTION

An object of this invention is to provide a heat sensitive recording sheet having excellent rise in the instantly developed color density on heating.

The above object of this invention can be attained by providing a heat sensitive recording sheet which contains, as a developer, one or more of 2,2'-bisphenolsulfide (n=o), 2,2'-bisphenolsulfoxide, and 2,2'-bisphenolsulfone compounds represented by the general formula (I)

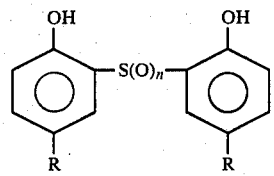

(I)

where R represents hydrogen, an alkyl radical of from 1 to 12 carbon atoms, a cycloalkyl radical of from 3 to 10 carbon atoms, an aralkyl radical of from 7 to 10 carbon atoms, and a phenyl radical, and may be identical to or different from each other, n is zero, or an integer of 1 or 2.

The heat sensitive recording sheet of the present invention has a much sharper rise in developed color density than that for the conventional recording sheet using bisphenol A, and shows a developed color density equal to or higher than that for the above conventional recording sheet.

The present invention has such advantages that a heat sensitive recording sheet, which is very advantageous for its handling and storage, and gives a developed color image having an excellent fastness to light and water resistance in addition to very little decrease in density of the developed color image with time, can be obtained at low cost.

DETAILED DESCRIPTION OF THE PREFERRED EMBODIMENTS:

Examples of the developer represented by the general formula (I) include, but not to be limited thereto,
2,2'-diphenolsulfide, 2,2'-diphenolsulfoxide,
2,2'-diphenolsulfone, 2,2'-bis(p-cresol)sulfide,
2,2'-bis(p-cresol)sulfoxide, 2,2'-bis(p-cresol)sulfone,
2,2'-bis(p-isopropylphenol)sulfone,
2,2'-bis(p-tert-butylphenol)sulfide,
2,2'-bis(p-tert-butylphenol)sulfoxide,
2,2'-bis(p-tert-butylphenol)sulfone,
2,2'-bis(p-tert-amylphenol)sulfide,
2,2'-bis(p-tert-amylphenol)sulfoxide,
2,2'-bis(p-tert-amylphenol)sulfide,
2,2'-bis(p-cyclohexylphenol)sulfide,
2,2'-bis(p-cyclohexylphenol)sulfone,
2,2'-bis(p-cumylphenol)sulfide, 2,2'-bis(p-cumylphenol)sulfoxide,
2,2'-bis(p-cumylphenol)sulfone, 2,2'-bis(p-phenylphenol)sulfoxide,
2,2'-bis(p-phenylphenol)sulfone,
2,2'-bis(p-tert-octylphenol)sulfoxide,
2,2'-bis(p-tert-octylphenol)sulfone,
2,2'-bis(p-dodecylphenol)sulfide,
2,2'-bis(p-dodecylphenol)sulfoxide,
2,2'-bis(p-dodecylphenol)sulfone, and the like.

A typical process for the preparation of the heat sensitive recording sheet of the present invention will be described below. The coupler usable in the present invention includes various materials which develop color by a fusion reaction thereof with a developer represented by the general formula (I). Examples of the coupler include electron donating and color assuming compounds such as 3,3'-bis(4-dimethylaminophenol)-6-
dimethylaminophthalide(crystal violet lactone),
3-diethylamino-6-methyl-7-chlorofluofluoran,
3-diethylamino-7-chlorofluoran, 3-cyclohexylamino-6-chlorofluoran,
3-diethylamino-7-dibenzylaminofluroran,
3-diethylamino-6-methyl-7-phenylaminofluoran,
1,3,3,-trimethylindolino-6'-chloro-8'-methoxyspiropyran, 3-methyl-2,2'-spiro bis(benzo [f] chromene), and the like.

A colorless or light colored coupler described as above, a developer represented by the general formula (I), or a mixture of a coupler, developer and a heat fusible material is thoroughly mixed with a solution prepared by dissolving a binder in water or an organic solvent, or with a dispersion of the binder therein to prepare a mixed solution.

Examples of the binder used for the preparation of the mixed solution include synthetic polymers such as styrene butadiene polymer, polyvinylalcohol, carboxymethylcellulose, hydroxyethylcellulose, polystyrene, vinylchloride-vinylacetate copolymer and acacia, and natural or modified natural polymers. Examples of the solvent used include organic solvents such as benzene, toluene, acetone, methylene chloride, ethyl acetate, and cyclohexane and water.

The mixed solution thus obtained is coated to be dried on a substrate such as paper, natural or synthetic resin film and the like. The mixed solution may be allowed to flow into the substrate to be impregnated therein. The method of mixing and method of coating described as above are not limited to the heat sensitive recording sheet of the present invention. For example, the coupler is mixed with a binder solution and separately the developer is mixed with a binder solution. Then both mixtures thus obtained may be mixed together for coating on the substrate, or these two mixtures may be separately coated on the substrate to be coated thereon twice. Both mixtures may be coated on the same surface or surfaces separate from each other of the substrate, or may be coated on different substrates, respectively.

The coating weight is generally above 0.5 g/m$^2$, preferably in the range of from 1 to 10 g/m$^2$ on a dry weight basis.

A relative amount of each component of the heat sensitive recording sheet is widely variable, but suitably in the range of from 1 to 15 parts by weight of the coupler, 1 to 95 parts by weight of the developer represented by the general formula (I), and 1 to 40 parts by weight of the binder respectively, on a dry weight basis.

According to the sensitive recording sheet of the present invention, the coupler and developer are brought into contact with each other, while they are prepared, coated, and dried before being heated. Nevertheless, the heat sensitive recording sheet of the present invention have such advantages that no blushing occurs due to color development, that stability thereof with time is maintained at a high level without lowering in color development performance by exposure thereof to light before reproduction, that the color development is effected instantly on heating and that the developed image has excellent light resistance and water resistance.

The present invention will be further explained by the following Examples.

The method of measurement and assessment for various performances of the recording sheet are shown below.

(1) Developed color density:

A recording sheet was subjected to heat color development under the following conditions,

| | |
|---|---|
| heating time | 5 seconds |
| pressure between heating material and recording sheet | 10g/cm$^2$ |
| on heating heating temperature range | 60 to 180° C. |

by use of Thermotest Rhodiaceta (manufactured by SETARAM CO.; Type 7401).

Reflectance (I) was measured in 10 minutes after color development by heating by use of an amber filter for a TSS type Hunter color difference meter (manufactured by Toyo Seiki Co., Ltd.). The lower the reflectance was, the higher the developed color density became.

(2) Fade resistance to light of developed image:

A sheet, developed according to the procedure in (1), was lighted for a time period of from 30 minutes to 6 hours by use of a carbon arc lamp and the following reflectances were measured by use of a Hunter color difference meter in the same manner as in (1), Io: reflectance of sheet before color development,
Is: reflectance of color developed sheet before lighting,
In: reflectance of color developed sheet n hours after lighting.

The fade resistance to light of the developed image is represented by use of the above reflectances as $$\text{Degree of residue} = \frac{In}{Io - In} \Big/ \frac{Is}{Io - Is} \times 100(\%)$$

A higher degree of residue is preferable.

(3) Storage stability:

A sheet before color development and a color-developed sheet were stored for 6 months at 25° C. and the reflectance of the sheet before color development and that of the color-developed sheet before storage are represented by Ko and Ko', respectively, and those after storage are represented by K and K', respectively. The smaller the values of differences of K-Ko and K'-Ko' are, the more the storage stability is preferable.

(4) Water resistance:

A color developed recording sheet was kept in water for 2 hours and a change in color density of a color developed image was observed with the naked eye.

EXAMPLE 1

| | | |
|---|---|---|
| Solution A: | crystal violet lactone | 7 g |
| | 10 wt % polyvinylalcohol (Kurare #217) | 30 g |
| | water | 13 g |
| Solution B: | 2,2'-bis(p-cresol)sulfide | 7 g |
| | 10 wt % polyvinylalcohol | 30 g |
| | water | 13 g |

Dispersions were prepared separately from solution A and B, respectively, by use of a sand grinding mill and two separate dispersions were mixed at such a ratio as 3 parts of solution A to 67 parts of solution B. The mixture was coated on fine paper and dried so that the coating weight could be in the range of from 2.5 to 3,5 g/m$^2$ on a dry basis to obtain a heat sensitive recording sheet.

Results of the performance assessment for heat sensitive recording sheets thus obtained are shown in Table 1.

EXAMPLES 2-10 AND COMPARATIVE EXAMPLE 1

The procedure of Example 1 was repeated except that other developers were used instead of the developer used in Example 1 to obtain heat sensitive recording sheets. Results of the performance assessment for heat sensitive recording sheets thus obtained and the developers used therein are also shown in Table 1.

TABLE 1

| Examples | Developers | Melting point (°C.) | developed color density (reflectance [1] %) 60 | 80 | 100 | 120 | 140 | 160 | 180 (°C.) | light resistance (degree of residue %) before light-ing | 0.5 | 2 | 4 | 6(hr) | Storage Stability (reflectance) sheet before color development (2)* [Ko] | (b)* [K] | Color development sheet (a')* [Ko'] | (b')* [K'] | (c)* |
|---|---|---|---|---|---|---|---|---|---|---|---|---|---|---|---|---|---|---|---|
| 1 | 2,2'-bis(p-cresol) sulfide | 116 ~ 117 | 40.5 | 25.5 | 15.3 | 11.2 | 11.0 | 11.0 | 10.5 | 100 | 96.1 | 79.1 | 24.8 | — | 87.4 | 87.4 | 14.9 | 16.5 | ○ |
| 2 | 2,2'-bis(p-tert-butylphenol)sulfide | 99 ~ 100 | 43.2 | 43.0 | 18.2 | 12.0 | 10.2 | 10.0 | 9.7 | 100 | 98.0 | 78.8 | 21.1 | — | 87.3 | 86.8 | 15.2 | 15.9 | ○ |
| 3 | 2,2'-bis(p-tert-butylphenol)sulfone | 131 ~ 132 | 44.5 | 44.2 | 27.5 | 12.3 | 11.1 | 10.5 | 10.0 | 100 | 97.1 | 79.9 | 27.0 | — | 88.5 | 88.3 | 15.7 | 15.8 | ○ |
| 4 | 2,2'-bis(p-tert-amylphenol)sulfide | 100 ~ 101 | 43.7 | 22.0 | 10.7 | 10.5 | 9.5 | 9.2 | 9.1 | 100 | 98.5 | 80.3 | 27.2 | — | 88.4 | 87.7 | 14.6 | 15.5 | ○ |
| 5 | 2,2'-bis(p-tert-amylphenol)sulfoxide | 122 ~ 123 | 44.2 | 44.0 | 41.2 | 17.5 | 10.6 | 10.2 | 10.0 | 100 | 92.5 | 70.1 | 23.2 | — | 89.0 | 89.0 | 15.9 | 16.8 | ○ |
| 6 | 2,2'-bis(p-tert-amylphenol)sulfone | 119 ~ 120 | 44.2 | 44.0 | 26.0 | 10.6 | 10.3 | 9.8 | 9.2 | 100 | 96.8 | 78.1 | 28.5 | — | 88.9 | 88.8 | 14.9 | 15.2 | ○ |
| 7 | 2,2'-bis(p-tert-octylphenol)sulfide | 135 ~ 136 | 44.7 | 44.6 | 44.7 | 24.0 | 10.5 | 10.1 | 10.0 | 100 | 90.1 | 72.3 | 23.0 | — | 89.7 | 89.4 | 15.8 | 16.5 | ○ |
| 8 | 2,2'-bis(p-tert-octylphenol)sulfoxide | 171 ~ 172 | — | — | — | 44.7 | 42.7 | 30.0 | 13.0 | 100 | 93.8 | 76.1 | 40.0 | 21.8 | 89.6 | 89.3 | 16.1 | 16.7 | ○ |
| 9 | 2,2'-bis(p-tert-octylphenol)sulfone | 143 ~ 145 | 44.8 | 44.5 | 41.7 | 19.7 | 11.6 | 11.0 | 100 | 96.5 | 78.8 | 31.1 | — | 89.6 | 89.5 | 15.7 | 16.5 | | ○ |
| 10 | 2,2'-bis(p-cumyl-phenol)sulfide | 82 ~ 83 | | 25.4 (70° C.) | 12.0 (80° C.) | 11.0 (90° C.) | 10.8 (100° C.) | — | — | 100 | 98.0 | 80.6 | 28 | 26 | 86.7 | 85.2 | 14.8 | 15.7 | ○ |
| Comparative Example | Bisphenol A | 156 | — | 38.3 | 24.4 | 15.7 | 10.2 | 9.2 | — | 100 | 97.6 | 79.2 | 25 | — | 88.3 | 88.1 | 15.1 | 15.9 | ○ |

*(a), (2') : before storage
*(b), (b') : after 6 months
*(c) water resistance

What is claimed is:

1. A heat sensitive recording sheet prepared by coating on a sheet substrate, or by impregnating therein a coupler, developer and binder, which is characterized in that said developer is one or more of 2,2'-bisphenolsulfide, 2,2'-bisphenolsulfoxide,and 2,2'-bisphenolsulfone compounds represented by the general formula (I)

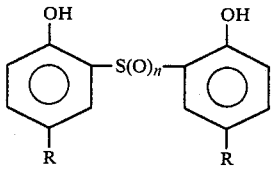

(I)

where R represents hydrogen, an alkyl radical of from 1 to 12 carbon atoms, a cycloalkyl radical of from 3 to 10 carbon atoms, an aralkyl radical of from 7 to 10 carbon atoms, and a phenyl radical, and may be identical to or different from each other, n is zero, or an integer of 1 or 2.

2. The heat sensitive recording sheet according to claim 1, wherein R in the general formula (I) is hydrogen, a methyl radical, a tert-butyl radical, an amyl radical, a tert-octyl radical, a nonyl radical, a dodecyl radical or a cumyl radical.

3. The heat sensitive recording sheet according to claim 1 or 2 wherein n is 0 .

4. The heat sensitive recording sheet according to claim 1 or 2 wherein n is 1.

5. The heat sensitive recording sheet according to claim 1 or 2 wherein n is 2.

6. The heat sensitive recording sheet according to claim 1 wherein said coupler and said developer are each admixed with said binder and are coated on different substrates.

7. The heat sensitive recording sheet according to claim 1 wherein said coupler, said developer and said binder are mixed together and coated on said substrate.

* * * * *